US006755923B2

(12) United States Patent
Lagacé

(10) Patent No.: US 6,755,923 B2
(45) Date of Patent: Jun. 29, 2004

(54) METHOD OF CONTROLLING METAL STRIP TEMPERATURE

(75) Inventor: Hélène Lagacé, Bath (CA)

(73) Assignee: Alcan International Limited, Montreal (CA)

( * ) Notice: Subject to any disclaimer, the term of this patent is extended or adjusted under 35 U.S.C. 154(b) by 183 days.

(21) Appl. No.: 10/032,689

(22) Filed: Dec. 27, 2001

(65) Prior Publication Data

US 2003/0121571 A1 Jul. 3, 2003

(51) Int. Cl.[7] ..... C22F 1/04; C21D 11/00
(52) U.S. Cl. ..... 148/511; 148/508; 148/688
(58) Field of Search ..... 148/688, 511, 148/508

(56) References Cited

U.S. PATENT DOCUMENTS

| | | | |
|---|---|---|---|
| 2,890,037 | A | 6/1959 | Rendel |
| 4,644,667 | A | 2/1987 | Yanagi et al. |
| 4,724,014 | A | 2/1988 | Misawa et al. |
| 4,913,748 | A | 4/1990 | Sellitto et al. |
| 6,263,714 | B1 | 7/2001 | Johnson et al. |

FOREIGN PATENT DOCUMENTS

JP 60-159127 A * 8/1985 ..... C21D/9/573

OTHER PUBLICATIONS

Database WPI, Sec. Ch, Week 198539, Derwent Pub. Ltd. Abstract of JP 60–159127A (Aug. 20, 1985).
Database WPI, Sec. Ch, Week 198444, Derwent Pub. Ltd. Abstract of JP 59–166630A (Sep. 20, 1984).

* cited by examiner

*Primary Examiner*—George Wyszomierski
*Assistant Examiner*—Janelle Morillo
(74) *Attorney, Agent, or Firm*—Cooper & Dunham LLP

(57) ABSTRACT

The recoiling temperature of a metal strip from a continuous heat treatment line is controlled by continuously passing the metal strip through an accumulator system where it passes around spaced accumulator rolls. While travelling through the accumulator, the metal strip is subjected to ambient cooling air and the length of aluminum strip travelling through the accumulator determines the amount of cooling that takes place. The length of the metal strip in the accumulator is in turn controlled by varying spacing between the accumulator rolls around which the metal strip travels. The spacing is preferably controlled by a programmed controller in response to temperature signals.

14 Claims, 2 Drawing Sheets

METHOD OF CONTROLLING METAL STRIP TEMPERATURE

FIELD OF THE INVENTION

The invention relates to a method and system for controlling the rewind temperature of strip metal, e.g. aluminum, in a continuous heat treatment line.

BACKGROUND ART

In the heat treatment of aluminum strip it is important to control the final temperature of the metal as it is rewound into coil form. This is because even at room temperature, the solutionized and quenched metal will undergo a process of microstructural transformation known as "aging". Once rewound, due to the large mass of the coil and relatively small exposed surface area, the metal cools to room temperature over a period of many hours during which time the aging process continues. The aging will proceed to a greater or lesser extent depending on the initial temperature of the coil and the coil cooling rate. A certain amount of controlled aging is sometimes desirable and for that reason coils may be wound at a controlled temperature above room temperature to take advantage of this phenomenon.

Currently there is no active control of strip temperature after the furnace and quench section of a continuous heat treatment line. The rewind temperature control is dependent upon establishing a heat treatment and quench practice for each product giving a strip temperature upstream from the accumulator to achieve approximately the desired temperature at the rewind. This method is unreliable because conditions in the line affecting heat transfer, such as ambient air temperature, air circulation, metal width and roll temperatures can vary considerably resulting in rewind temperatures too high or too low. The only way to compensate for this has been to alter conditions upstream in the furnace or quench. This has the major disadvantages of providing very little ability to change conditions without potentially affecting the heat treatment of the metal, limited ability to predict or control the effect of the changes and slowness of response when furnace or cooler temperatures must be changed.

Johnson et al. U.S. Pat. No. 6,263,714, issued Jul. 24, 2001 describes a control system for a rolling mill in which metal strip is processed between an unwind reel and a rewind reel. It includes a programmed controller for controlling the system.

In Sellitto et al. U.S. Pat. No. 4,913,748, issued Apr. 3, 1990 an apparatus is described for the continuous annealing of strip metal. The rate at which the metal strip is fed through the system is regulated by a feed controller which includes a catenary loop of the metal strip. The size of the loop may be controlled such that a furnace may be operated concurrently to anneal the strip and function as an accumulator.

It is an object of the present invention to provide rapid and automated control of rewind temperature in a heat treatment line without affecting heat treatment or quench conditions upstream.

SUMMARY OF THE INVENTION

The present invention in one aspect relates to a method of controlling the recoil temperature of metal strip in a continuous heat treatment line. Hot, heat-treated metal strip is continuously passed through an accumulator system where it passes around at least two accumulator rolls in a spaced relationship. While travelling between the accumulator rolls, the metal strip is exposed to ambient cooling air. In order to control the amount of cooling, the length of metal strip exposed to the ambient cooling air is controlled. This exposed strip length is in turn controlled by varying the distance between the spaced accumulator rolls around which the strip travels. Thus for a greater amount of cooling, the spaced accumulator rolls are positioned further apart and for a lower degree of cooling the rolls are brought closer together.

Typically the invention uses an accumulator tower consisting of an upper and lower bank of rolls which banks of rolls can be brought together or moved apart to control the recoil temperature. The moving aluminum strip is passed alternately between the upper rolls and lower rolls to form a number of strands before passing out of the accumulator to the rewind reel or coiler.

The distance between the upper and lower roll sets and thus the length of metal strip subjected to ambient cooling air may conveniently be controlled by a programmed controller in response to a measured temperature of the metal strip at the rewind reel used as a feed back signal to the controller. As there may be some lag time between a change in conditions upstream, e.g. in the temperature of metal entering the accumulator, and the detection of the change of temperature at the rewind, it is preferable to also incorporate a feed forward signal to the controller. This may be accomplished by obtaining a strip temperature signal at some point prior to the accumulator and then by means of a mathematical model of the process calculate the required adjustment in strip length (accumulator spacing) to achieve the correct temperature at the rewind reel under the new conditions. The mathematical model may incorporate inputs of heat transfer coefficients, pressures and temperatures of the heat transfer media in each section of the line, as well as strip speed, thickness and width. Then using an appropriate algorithm in a programmable logic controller (PLC) a calculation is made as to the required accumulator spacing. The reference temperature for the feed forward signal may be the entry temperature to the line or a temperature taken at any other point in the line provided that a reasonably accurate model can be constructed to predict strip temperature from that point forward to the rewind reel.

BRIEF DESCRIPTION OF THE DRAWINGS

In the drawings which illustrate certain preferred embodiments of this invention.

DESCRIPTION OF THE PREFERRED EMBODIMENTS

Figure 1:
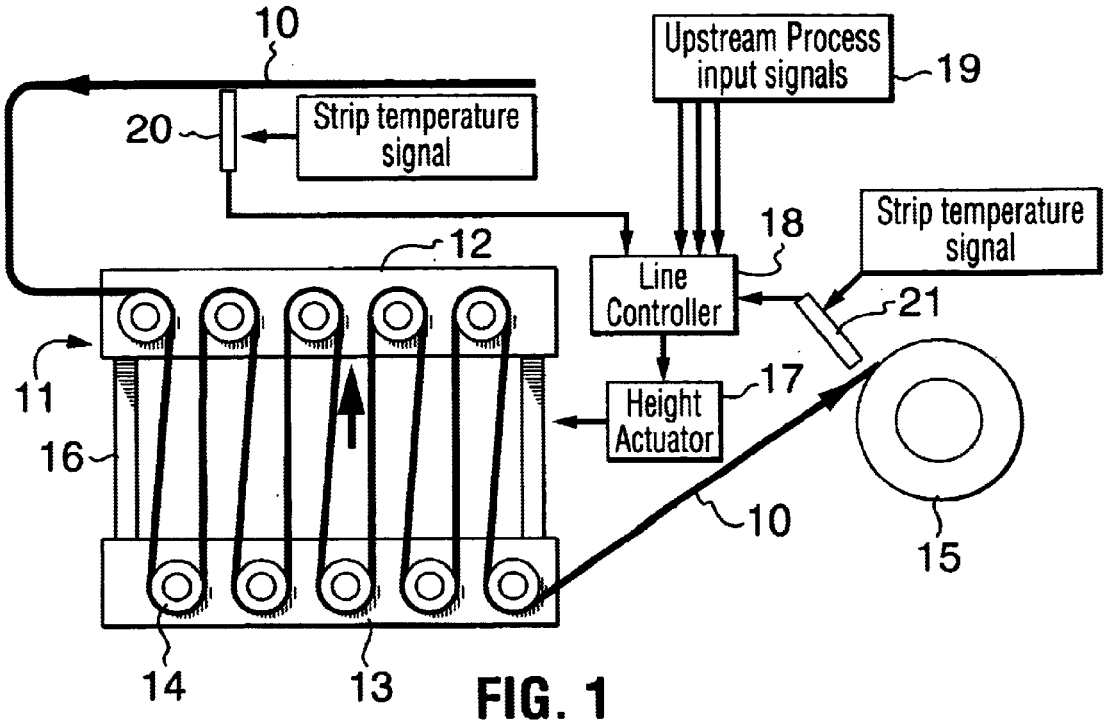
FIG. 1 is a schematic view of a system in accordance with this invention with a maximum spacing of the accumulator rolls.
Figure 2:
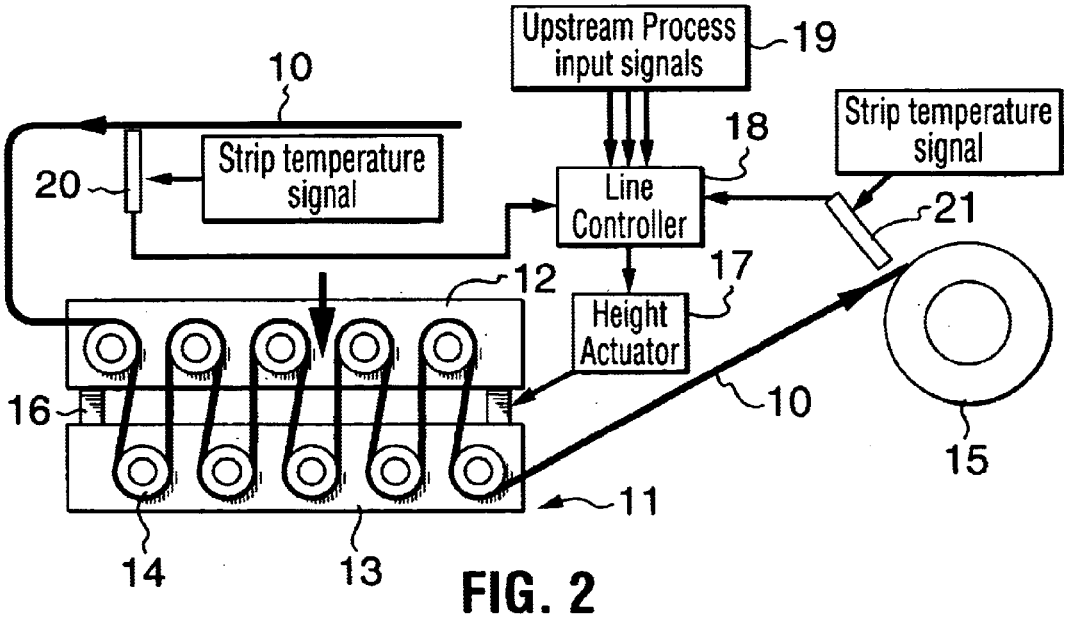
FIG. 2 is a schematic illustration of the system of this invention with the accumulator rolls in their closest position.

In the system of this invention, a continuous aluminum strip 10 from a heat treatment line is fed through an accumulator tower 11 consisting of an upper roll carriage 12 and a lower roll carriage 13. In this illustration five rolls 14 are mounted in each of the upper and lower carriages 12 and 13. From the accumulator tower 11 the metal strip 10 continues to rewind reel 15.

As the aluminum strip 10 passes alternately around the upper and lower rolls 14 it comes into contact with ambient cooling air thereby lower the temperature of the aluminum strip being rewound on coil 15.

The spacing between the upper roll carriage 12 and the lower roll carriage 13 is achieved by means of a variable spacing mechanism 16 which may be electrical or hydraulic. This is operated by means of a height actuator 17 based on a signal that is received from programmable logic controller (PLC) 18.

In a typical system, one of the roll carriages 12, 13 is attached to chain links, or cables. Tension is applied to the cables or chains which are connected through sprockets or shieves to an AC or DC electric motor. The force provided by the motor through the chains or cables supports the weight of the rolls 14 and the strip 10 as well as providing any desired constant strip tension. A feedback signal is provided from a load cell mounted on at least one of the accumulator rolls 14 over which the strip passes to allow for control of the tension at the reference value. The position of the roll carriage is controlled by providing a position feedback signal from a position transducer on the roll carriage or by an encoder on the motor shaft. The position of the moveable accumulator roll carriage relative to the fixed carriage can be changed by increasing or decreasing the speed of the strip into the accumulator relative to the speed of the strip out of the accumulator. When the desired position is achieved the inlet and outlet speed are again matched to maintain a new constant position. As the rolls are moving to the new position the motors drive the chains or cables to maintain correct tension.

A hydraulic system functions in a similar fashion. However, the force required to support and tension the strip is provided by hydraulic cylinders coupled to the moveable carriage, in place of the motors. Typically an electrical position transducer is employed to provide the position feedback signal required for position control.

The controller 18 receives a series of upstream process input signals 19 including heat transfer coefficients, pressures and temperatures of the heat transfer media in each section of the line and the strip speed, thickness and width. The processor 18 includes an algorithm which calculates the required accumulator opening based on input information and responds by providing a signal to height actuator 17.

Controller 18 reacts primarily in response to a temperature monitor 21 which provides a strip temperature signal for the strip at the rewind reel 15. This is referred to as the feed back signal.

A second temperature input may be provided by temperature monitor 20 in a feed forward location. This may be the entry temperature to the line or any other point in the line provided that a reasonably accurate model can be constructed to predict strip temperature from that point forward to the rewind reel 15.

In a typical operation, the strip metal travels at a line speed of about 6–120 m/min., preferably 16–60 m/min. with a speed of 16–40 m/min. being most preferred. The starting strip temperature prior to entering the accumulator is typically at a maximum of about 100° C. and preferably no more than about 140° C. The temperature drop that can be achieved with the system is a maximum of about 100° C. and typically a maximum of about 60° C.

The maximum spacing of the upper and lower banks of rolls is typically in the range of about 2–18 meters, preferably about 2–12 meters, with the height of about 2–6 meters being particularly preferred. The strip gauge is typically about 0.1–6.0 mm, preferably 0.8–2.1 mm.

The temperature of the strip at the rewind reel 15 is normally in the range of ambient to 130° C., preferably about 50–100° C. and most preferably about 70–90° C.

While the above description refers to upper and lower banks of rolls in the accumulator, it will be understood that the system functions equally well with the banks of rolls horizontally spaced.

EXAMPLE 1

Figure 3:
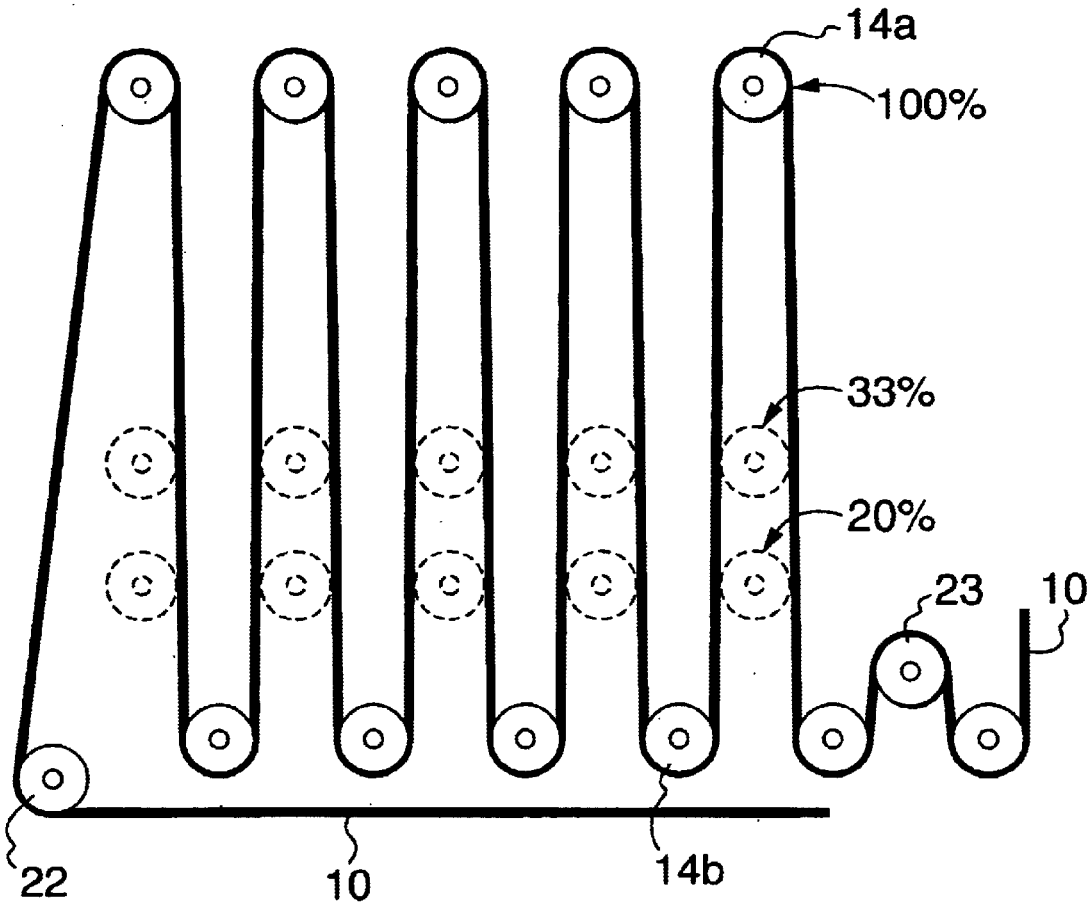
FIG. 3 is a schematic illustration of an accumulator showing three different roll locations.

FIG. 3 shows an accumulator arrangement that was used for experimental runs. For these trials, the upper bank of rolls 14*a* were set at three different locations shown on the drawing as 20%, 33% and 100%. The 20% location is the normal position during switch over of coils or running without adjustment of temperature. The 33% position represents a preset position to try to control the rewind temperature and the 100% position is the full height of the accumulator. The 20% position represents 35.25 meters of metal strip travelling through the accumulator, the 33% position represents 58.16 meters of metal strip in the accumulator and the 100% position represents 176.3 meters of strip within the accumulator.

A first coil of 0.9 mm gauge AA6111 aluminum alloy was run at a speed of 32.3 m/min., first at the 20% position and then at the 33% position. The temperature at the rewind dropped by about 10° C. between the two positions.

A second test was conducted on a 2.0 mm gauge aluminum alloy running at a speed of 16.2 m/min. and in that case the temperature at the rewind dropped by about 7° C.

What is claimed is:

1. A method of controlling the recoil temperature of metal strip in a continuous heat treatment line, which comprises continuously passing hot, heat-treated aluminum strip having a thickness of about 0.1 to 6.0 mm alternately around spaced apart accumulator rolls, exposing the aluminum strip to ambient cooling air while travelling between said spaced apart rolls at a speed of about 6–120 m/min, controlling the temperature of the aluminum strip emerging from the accumulator rolls by sensing temperature conditions of the aluminum strip and communicating said sensed temperature conditions to a controller which acts to vary the distance between said spaced apart rolls to thereby vary the length of aluminum strip exposed to said cooling air and rewinding the aluminum strip at a controlled temperature in coil form.

2. The method of claim 1 wherein the temperature conditions of the aluminum strip are sensed immediately before rewinding.

3. The method of claim 1 wherein temperature conditions of the aluminum strip are sensed upstream of the accumulator rolls.

4. The method of claim 1 wherein the controller is programmed and stores information on the aluminum strip thickness, width and travel speed.

5. The method of claim 4 wherein the controller also stores information on the heat transfer coefficient, pressure and temperature of the heat transfer media.

6. The method of claim 1 wherein the accumulator rolls are arranged in spaced apart rows of rolls between which the aluminum strip alternately passes and the length of aluminum strip passing around the accumulator rolls is controlled by varying the spacing of the rows of rolls.

7. The method of claim 6 wherein the rows of rolls are spaced about 2–18 meters apart.

8. The method of claim 1 wherein the aluminum strip has an initial temperature of up to 160° C. and is cooled to a temperature in the range of ambient to 130° C. for rewinding.

9. A method of controlling the recoil temperature of metal strip in a continuous heat treatment line, which comprises continuously passing hot, heat-treated aluminum strip having a thickness of about 0.1 to 6.0 mm alternately around spaced apart accumulator rolls, exposing the aluminum strip to ambient cooling air while travelling between said spaced apart rolls, controlling the temperature of the aluminum strip emerging from the accumulator rolls by sensing temperature conditions of the aluminum strip and communicating said sensed temperature conditions to a controller which acts to vary the distance between said spaced apart rolls to thereby vary the length of aluminum strip exposed to said cooling air, the aluminum strip having an initial temperature of up to 160° C. and being cooled by the cooling air to a temperature in the range of ambient to 130° C., and rewinding the aluminum strip at a controlled temperature in the range of ambient to 130° C. in coil form.

10. The method of claim 9 wherein the temperature conditions of the aluminum strip are sensed immediately before rewinding.

11. The method of claim 9 wherein temperature conditions of the metal strip are sensed upstream of the accumulator rolls.

12. The method of claim 9 wherein the controller is programmed and stores information on the metal strip thickness, width and travel speed.

13. The method of claim 12 wherein the controller also stores information on the heat transfer coefficient, pressure and temperature of the heat transfer media.

14. The method of claim 9 wherein the accumulator rolls are arranged in spaced apart rows of rolls between which the aluminum strip alternately passes and the length of aluminum strip passing around the accumulator rolls is controlled by varying the spacing of the rows of rolls.

* * * * *